US008632352B2

(12) United States Patent
Wagner

(10) Patent No.: US 8,632,352 B2
(45) Date of Patent: Jan. 21, 2014

(54) METHOD AND APPARATUS FOR LOCKING A NETWORK CABLE IN A JACK

(75) Inventor: Justin S. Wagner, York, PA (US)

(73) Assignee: Sentinel Connector Systems, Inc., York, PA (US)

( * ) Notice: Subject to any disclaimer, the term of this patent is extended or adjusted under 35 U.S.C. 154(b) by 81 days.

(21) Appl. No.: 12/899,692

(22) Filed: Oct. 7, 2010

(65) Prior Publication Data

US 2012/0088392 A1 Apr. 12, 2012

(51) Int. Cl.
*H01R 13/627* (2006.01)

(52) U.S. Cl.
USPC ..... 439/352

(58) Field of Classification Search
USPC ..... 439/136, 133, 304, 354, 352
See application file for complete search history.

(56) References Cited

U.S. PATENT DOCUMENTS 4,647,726 A * 3/1987 Blum ..... 379/435
5,090,916 A * 2/1992 Magnier ..... 439/352
6,290,527 B1 * 9/2001 Takaya et al. ..... 439/352
6,821,024 B2 * 11/2004 Bates, III ..... 385/76
6,851,957 B1 * 2/2005 Bhogal et al. ..... 439/133
7,163,414 B2 * 1/2007 Lo et al. ..... 439/352
7,204,721 B2 * 4/2007 Lundholm et al. ..... 439/676
7,632,125 B2 * 12/2009 Irwin et al. ..... 439/304
7,806,706 B2 * 10/2010 Obenshain ..... 439/133
7,892,012 B1 * 2/2011 Foung ..... 439/352
8,287,197 B2 * 10/2012 Sasaki et al. ..... 396/529
2003/0063862 A1 * 4/2003 Fillion et al. ..... 385/53
2010/0136809 A1 * 6/2010 Andres et al. ..... 439/133

* cited by examiner

*Primary Examiner* — Neil Abrams
*Assistant Examiner* — Travis Chambers
(74) *Attorney, Agent, or Firm* — Arent Fox LLP

(57) ABSTRACT

A method and apparatus provide for a physically small, simple, and inexpensive securing of a conventional RJ45 or similar plug into a conventional jack. A tab lock is configured to slide forward and backward along the plug, wherein when the tab lock is slid forward, a distally extending tongue reaches underneath a release lever to hinder the bending of the release lever. In this way a latch coupled to the release lever is prevented from un-latching with a corresponding latch in the jack. When the tab lock slides backward the tongue is removed from underneath the release lever and the plug may be removed from the jack. The tab lock further provides for visual identification of a particular plug.

16 Claims, 10 Drawing Sheets

METHOD AND APPARATUS FOR LOCKING A NETWORK CABLE IN A JACK

BACKGROUND

1. Field

The present disclosure relates generally to the field of securing network plugs, and more particularly to a method and apparatus for locking a network cable in a jack.

2. Background

In a typical network server room or other data center large numbers of computer systems such as servers are kept in racks, and even larger numbers of cables are plugged into these servers, sometimes resulting in a seemingly unmanageable number of plugs and cables, as illustrated in FIG. 10C. Further, the plugs at the ends of each of the cables are sometimes located very close together, so that even if someone correctly determines which cable they would like to disconnect, they may inadvertently disconnect the wrong cable or additional cables beyond the one intended.

Many of these cables are connected to network equipment utilizing a standard 8-position 8-contact (8P8C) connector, frequently called an RJ45 connector. This connector is widely used for local area networks using the Ethernet protocol and is likely to be familiar to any computer user. FIG. 10A is one example of such an RJ45 connector as illustrated in national standard ANSI/TIA-1096-A, incorporated by reference herein in its entirety. In the illustration, the plug 1000 includes a release lever 1010, and at least one latch 1020 coupled to the release lever 1010. FIG. 10B illustrates an array of jacks 1030 configured to accept the RJ45 connector 1000. Inside the jack 1030 is a latch (not illustrated) corresponding to the latch 1020 on the plug 1000 such that when the plug 1000 is inserted into the jack 1030, the latch 1020 of the plug 1000 engages with the corresponding latch of the jack 1030 to secure the plug 1000 in the jack 1030.

In order to reduce the likelihood of an inadvertent disconnect of a plug from a jack, or to improve security when an important connection may be accessed by unauthorized individuals, certain cable locks have been developed in the prior art. Some of these cable locks, such as the ones illustrated in FIGS. 1C, 1D, and 1E use a lock-and-key mechanism, with an aim to prevent unauthorized removal of cables. That is, a key or other removal tool supplied by the provider of the cable lock may be carried by a system administrator, and is required for removal of the plug from the jack.

Further, some cable locks in the prior art utilize a modified jack, for example, including a specialized latch mechanism or fastener, such as a screw-lock, to hold the plug in place. Still other cable locks in the prior art such as the ones illustrated in FIGS. 1A and 1B utilize a housing having a bulk that fastens to the plug and simply blocks access to the release mechanism and/or prevents the bending of the release lever to release the latch.

These and other prior art examples of cable locks suffer from one or more of the following disadvantages: large size (i.e., requiring widely spaced jacks and/or protruding jacks), the need for a key or other tool to remove the plug, high price, or the need for a specialized jack to accept the lock mechanism. Thus, there is a desire in the field for an improved cable locking mechanism.

SUMMARY

The following presents a simplified summary of the disclosure in order to provide a basic understanding of certain disclosed embodiments. This summary is not an extensive overview of all contemplated embodiments, and is intended neither to identify key or critical elements, nor to delineate the scope of such embodiments. Its sole purpose is to present some concepts of certain disclosed embodiments in a simplified form as a prelude to a more detailed description, presented later.

In various representative aspects, the instant disclosure provides for a method and apparatus for securing a plug in a jack. Exemplary features may include a tab lock that a user may slide forward to place a distally extending tongue underneath a release lever, such that pressing down on the release lever does not disengage a latch from holding the plug in the jack. The user may further slide the tab lock backward to remove the distally extending tongue from underneath the release lever such that the release lever functions normally enabling the plug to be released from the jack. In one aspect, the disclosure provides a method of securing a plug in a jack. Here, the plug is inserted into the jack to engage a latch on the plug into the jack. A tab lock is pressed forward to slide at least a portion of a distally extending tongue of the tab lock underneath a portion of a release lever coupled to the latch.

Another aspect of the disclosure provides an apparatus for securing a plug in a jack. A tab lock includes a distally extending tongue, wherein at least a portion of the distally extending tongue is configured to slide underneath a release lever of the plug to hinder a releasing of a latch coupled to the release lever from a corresponding latch in the jack.

These and other aspects are more fully comprehended upon review of this disclosure.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1B:
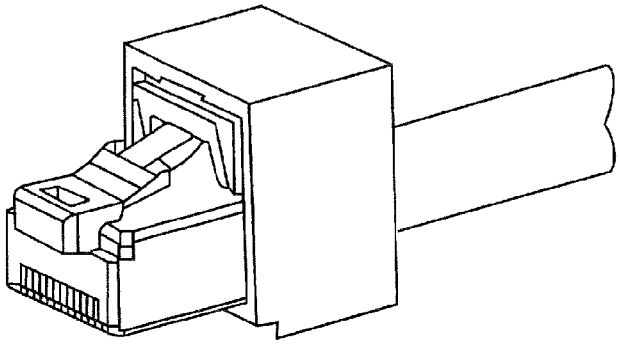
FIG. 1B (Prior Art)
FIGS. 1A-1E are illustrations of prior art cable lock mechanisms.
Figure 1A:
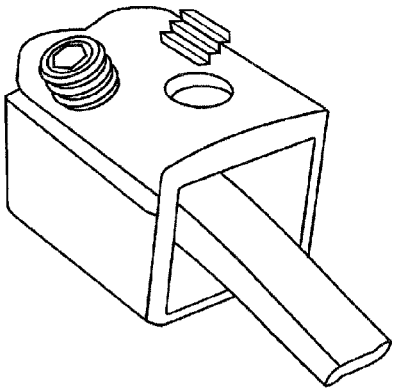
FIG. 1A (Prior Art)
Figure 1C:
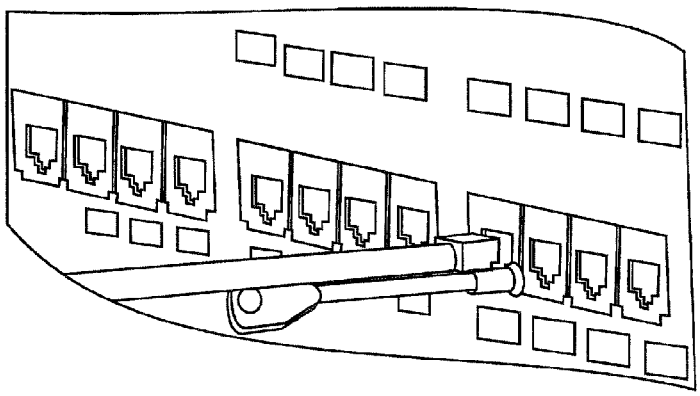
FIG. 1C (Prior Art)
Figure 1D:
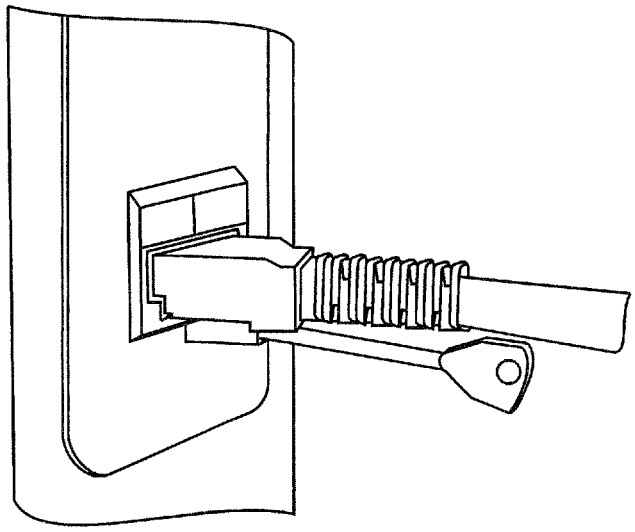
FIG. 1D (Prior Art)
Figure 1E:
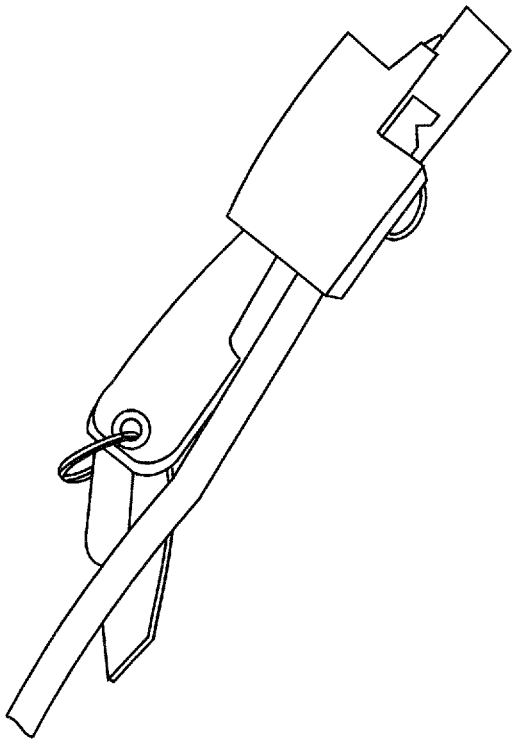
FIG. 1E (Prior Art)

In the following detailed description, only certain exemplary embodiments of the present invention are shown and described, by way of illustration. As those skilled in the art would recognize, the invention may be embodied in many different forms and should not be construed as being limited to the embodiments set forth herein. Also, in the context of the present application, when an element is referred to as being "on" another element, it can be directly on the other element or be indirectly on the other element with one or more intervening elements interposed therebetween. Also, in the context of the present application, when an element is referred to as being "connected" or "coupled" to another element, it can be directly connected or coupled to the other element or be indirectly connected or coupled to the other element with one or more intervening elements interposed therebetween. Like reference numerals designate like elements throughout the specification.

Further, the present disclosure may be made in relation to an RJ45 plug. Those skilled in the art will comprehend that the broad concepts described in the disclosure and shown in the illustrations can be applied to other plugs and interfaces besides the RJ-45 plug, such as but not limited to any suitable registered jack (RJ) (e.g., RJ14, RJ11, etc.) or any other suitable plug having a release lever and a latch coupled to the release lever.

Figure 2:
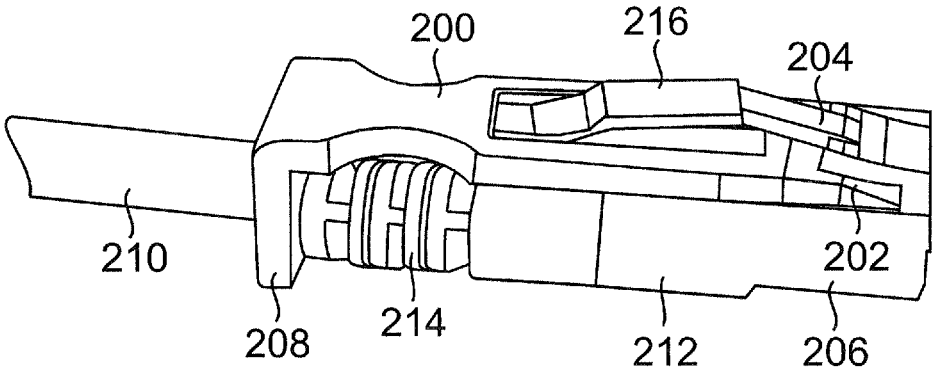
FIG. 2 is a perspective view of a cable lock apparatus in its locked position according to an exemplary aspect of the present disclosure.

Methods and apparatus for securing and removing a cable plugged into a jack may operate in conjunction with a tab lock 200. Referring now to FIG. 2, a perspective view of an RJ-45 plug utilizing an exemplary embodiment according to one aspect of the disclosure is illustrated in a closed or locked position. Here, a tab lock 200 includes a distally extending tongue 202 configured to slide underneath a release lever 204 of an RJ-45 plug 206 to prevent the release lever from bending downward to such an angle that the plug will be released from a jack. The tab lock 200 further includes a clasp 208 for loosely securing the tab lock 200 to a cable 210. Here, the clasp 208 is suitably loose to enable the tab lock 200 to slide along the top surface of the plug 206. In one embodiment the clasp 208 is configured to loosely secure the tab lock 200 to a category 5 (cat5) cable, although the clasp 208 may be configured for any suitable cable. Further, the clasp 208 may be utilized as a visual indicator that a particular tab lock is in the locked or unlocked position.

A base 212 may be coupled to the plug 206. Here, the base 212 includes a strain relief member 214 and a finger 216. The strain relief member 214 is an optional component that may provide structural integrity enabling significant usage of the mechanism without damaging the cable 210. The finger 216 extends upward and forward from the base 212, through the tab lock 200, and at its end, rests upon the release lever 204 of the plug 206.

Figure 3:
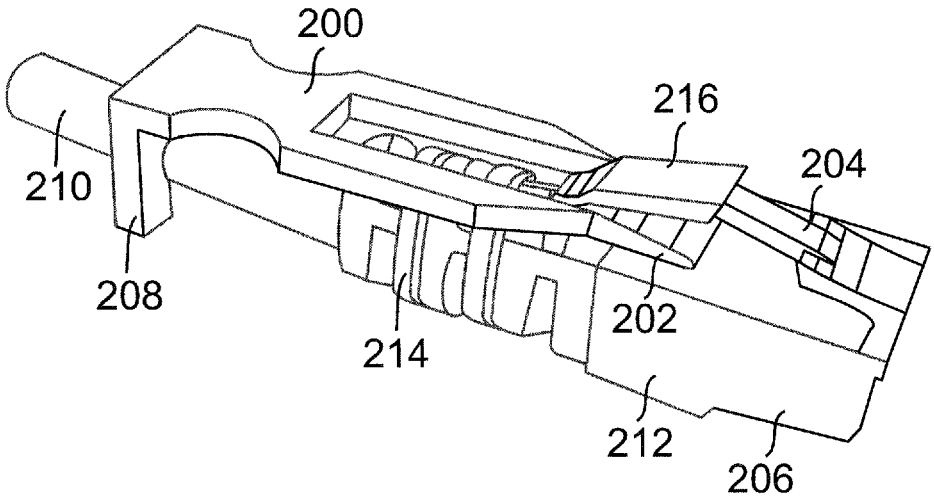
FIG. 3 is a perspective view of the cable lock apparatus of FIG. 2 in its unlocked position according to an exemplary aspect of the present disclosure.

FIG. 3 illustrates a perspective view of the same RJ-45 plug and tab lock as that illustrated in FIG. 2, in an open or unlocked position. Here, as the tab lock 200 is slid backward or in a direction away from the plug 206, the tongue 202 is removed from underneath the release lever 204, such that pressing downward on the release lever 204 or on the finger 216 causes the release lever 204 to bend downward and release the plug 206 from a jack. Here, if the tab lock 200 is slid backward to its limit, a bottom portion of the finger 216 of the base 212 engages or blocks the tongue 202 from sliding any further, holding the tab lock 200 in place.

Figure 4:
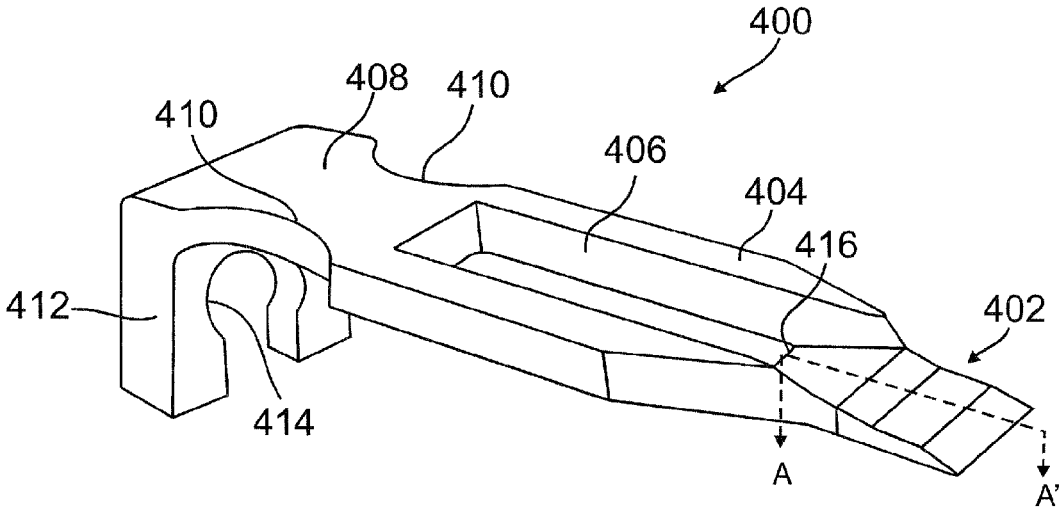
FIG. 4 contains two views of a tab lock in accordance with an exemplary aspect of the present disclosure.
Figure 4:
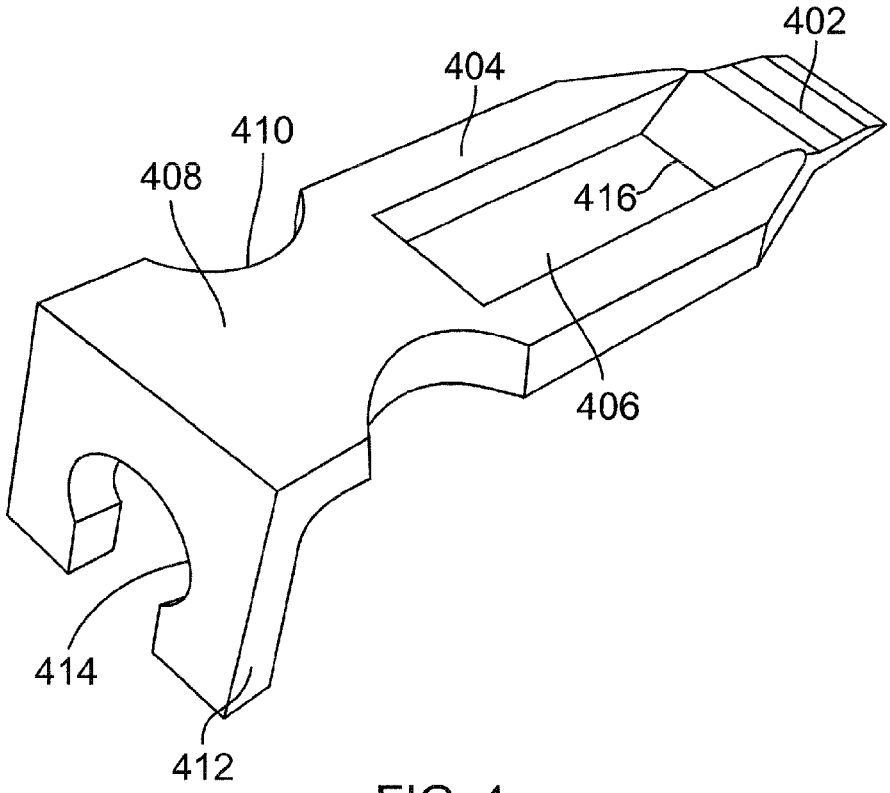

FIG. 4 is a close-up perspective view illustrating details of a tab lock 400. Here, the tab lock 400 may be the same as the tab lock 200 illustrated in FIGS. 2 and 3. The tab lock 400 includes a tongue 402 for facilitating the locking of the plug, and an extending arm 404 for extending the tongue 402 to a suitable distance from the body 408 of the tab lock 400. Here, there are two extending arms 404 on either side of a slot 406 through which the finger 216 of the base 212 (see FIG. 2) may extend. The body 408 of the tab lock 400 may include one or more grips or recessed portions 410 to facilitate gripping of the body 408 of the tab lock 400 when a user wishes to grasp and lock or unlock the tab lock 400. A flange 412 extends downward from the body 408 of the tab lock 400, including an opening 414 for clasping onto a cable. Here, the opening 414 may be suitably sized in accordance with the size of cable being utilized such that it loosely clasps onto the cable to enable sliding of the tab lock 400 into and out of the closed or locked position.

Figure 5:
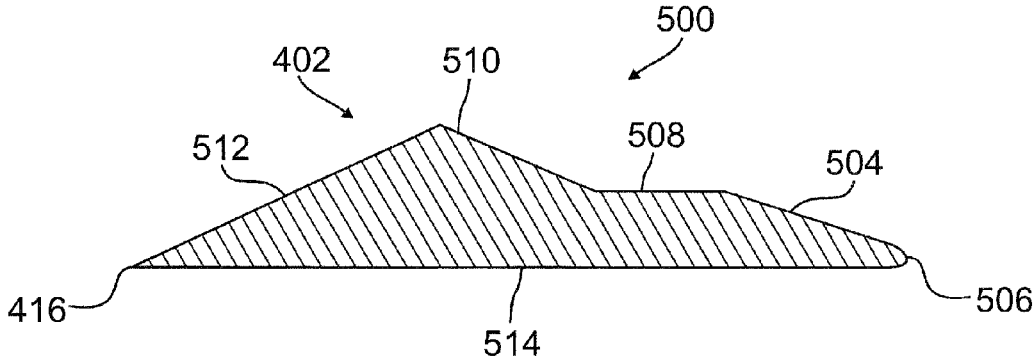
FIG. 5 is a cross section of a distally extending tongue of the tab lock illustrated in FIG. 4 in accordance with an exemplary aspect of the present disclosure.

FIG. 5 is a cross-sectional view 500 illustrating further details of the tongue 402 taken along line A-A' in FIG. 4. In FIG. 5, the tongue 402 includes a first facet 504 that tapers to a distal tip 506. Here, the tip 506 may be slightly rounded to reduce or prevent damage if the tongue 402 is pushed forward such that the tip 506 impacts the underside of the release lever 204 of the plug 206 (see FIG. 2). The tongue 402 further includes a second facet 508 that may be generally parallel with a bottom surface 514 of the tongue 402, and a third facet 510 that angles upward from the second facet 508. The tongue 402 further includes a fourth facet 512 that tapers back downward toward the bottom surface 514 until it terminates. The bottom surface 514 may be substantially flat.

In the illustrated example, the angle $\theta$ between the first facet 504 and the bottom surfaced 514 at the tip 506 of the tongue 402 may be about 13°. The first facet 504 rises to a height of about 0.029 inches from the bottom surface 514, and the second facet 508 maintains the thickness of about 0.029 inches for its length, which may be substantially parallel with the bottom surface 514. The third facet 510 rises from the second facet 508 with an angle $\phi$ of about 15° with respect to a line parallel to the bottom surface 514. Of course, those of ordinary skill in the art will comprehend that these exact numerical values for the dimensional characteristics of the tongue 402 may vary within the scope of this disclosure to other suitable values to perform equivalent functions.

Figure 6:
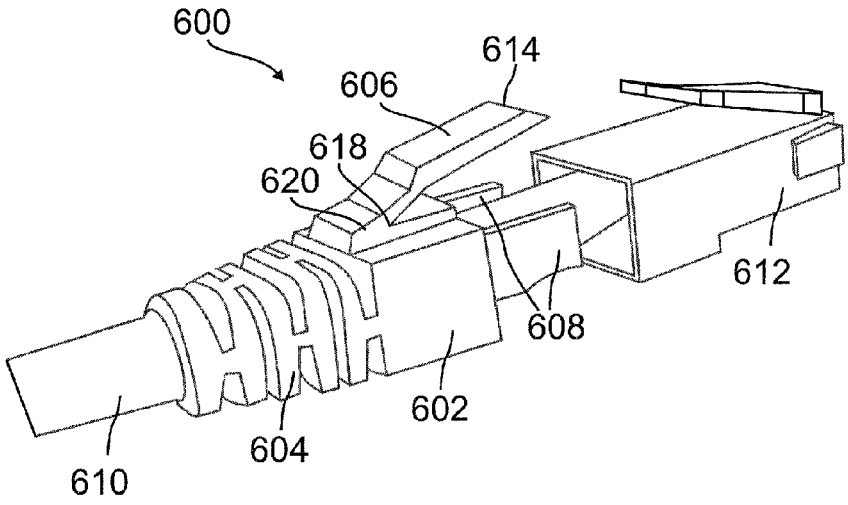
FIG. 6 is a view of a base and strain relief member of a cable lock apparatus in accordance with an exemplary aspect of the present disclosure.

FIG. 6 is a perspective view of a base 600 in accordance with an exemplary aspect of the disclosure. Here, the base 600 may be the same as the base 212 illustrated in FIG. 2. In FIG. 6, the base 600 includes a body 602, a strain relief member 604, a finger 606, and one or more fasteners 608. The body 602 may be a foundational structure of the base 600 to which other portions may be affixed. For example, the strain relief member 604 may be affixed to a rear portion of the body 602 to provide strain relief to a cable 610; the finger 606 may be affixed to a top portion of the body 602; and the one or more fasteners 608 may be affixed to a front portion of the body 602 to fasten the base 600 to the RJ-45 jack 612. The finger 606 may serve multiple purposes. For example, the end 614 of the finger 606 may be configured to lay atop the release lever of the plug 612, such that, when the base 600 is engaged with the plug 612, the user may press down on the finger 606, which thereby presses down on the release lever to allow the plug 612 to be removed from the jack. To assist in this purpose the end 614 of the finger 606 may include a recessed portion for engaging the tip of the release lever. Further, as illustrated, the finger 606 extends forward towards the plug 612 such that foot 620 and the finger 606 form an inner corner 618. The inner corner 618 may function to limit the play of the tab lock 400. That is, when the tab lock 400 is pulled outward to release the lock and enable the plug 612 to be removed from the jack, the proximal edge 416 (see FIGS. 4 and 5) of the fourth facet 512 may come into contact with the inner corner 618 to stop the sliding of the tab lock 400. In this way, the likelihood that tab lock 400 is inadvertently removed completely from the plug 612 when it is pulled into the unlocked position may be reduced or eliminated.

Figure 7A:
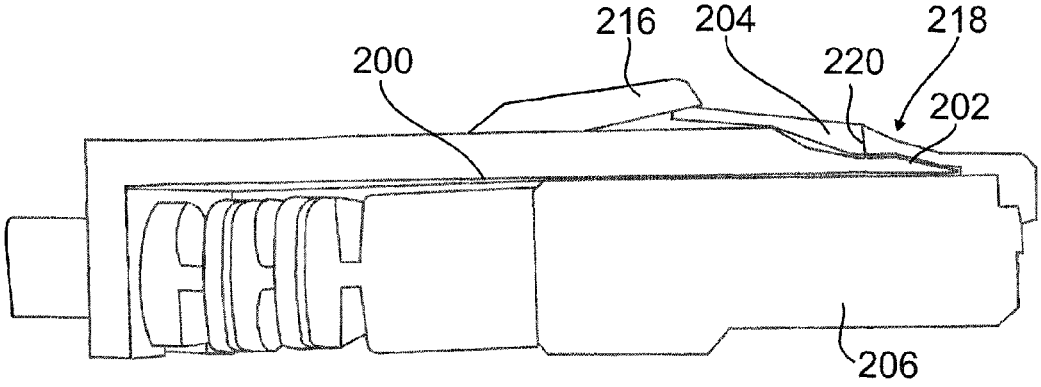
FIGS. 7A and 7B illustrate a cable lock apparatus in its locked position substantially preventing a latch from moving to a position that would disengage the plug from the jack in accordance with an exemplary aspect of the present disclosure.
Figure 7B:
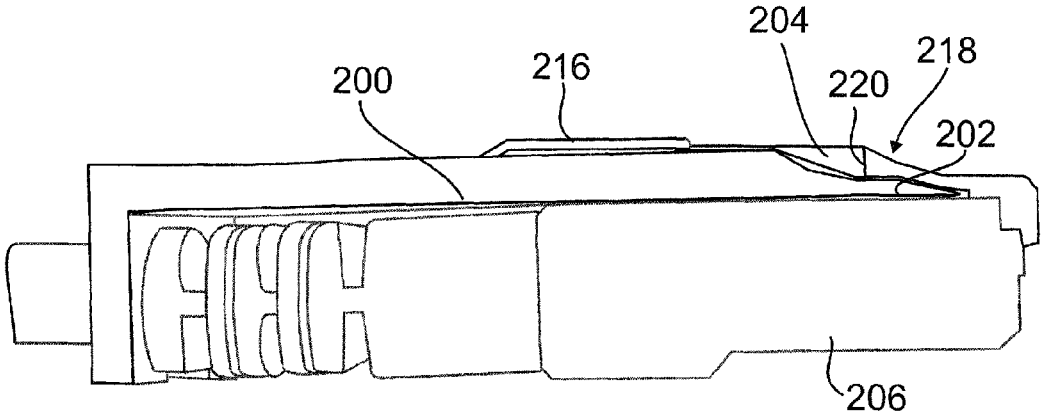

FIGS. 7A and 7B illustrate the tab lock 200 in its forward or locked position, wherein the tongue 202 is inserted underneath the release lever 204 of the plug 206. In FIG. 7A, neither the release lever 204 nor the finger 216 are being pressed. In this figure, the tongue 202 is in its forward position to reduce or prevent the forward portion 218 of the release lever 204 from bending downward even if the release lever 204 or the finger 216 are pressed downward. Thus, the latch 220, which is configured to latch onto a corresponding flange in the jack in which the plug 206 is to be inserted (not illustrated), would remain latched even when the release lever 204 or the finger 216 are pressed. FIG. 7B illustrates the finger 216 being pressed downward in such a way as to press downward on the release lever 204. Here, the release lever 204 bends downward; however, because the tongue 202 is in its forward position, the forward portion 218 of the release lever 204 largely remains in its upward position, and the latch 220 remains at a position where it retains its latching function to hold the plug 206 inside the jack.

Figure 8A:
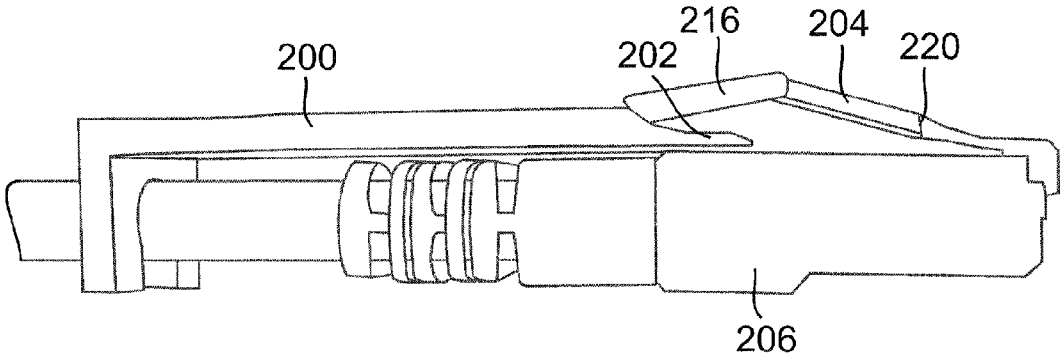
FIGS. 8A and 8B illustrate a cable lock apparatus in its unlocked position enabling a latch to move to a position that would disengage the plug from the jack in accordance with an exemplary aspect of the present disclosure.
Figure 8B:
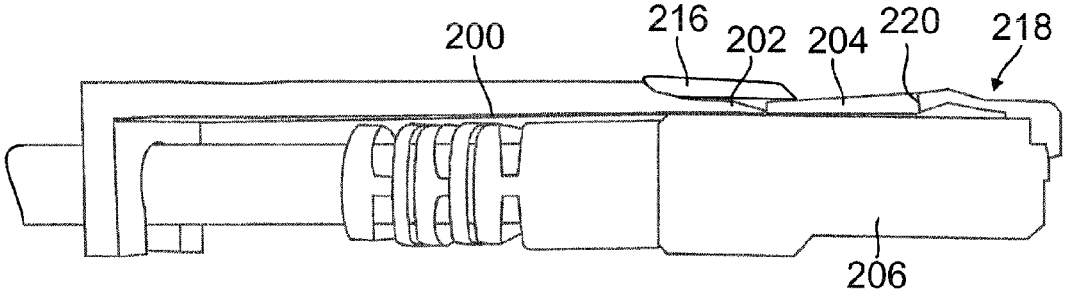

FIGS. 8A and 8B illustrate the tab lock 200 in its reverse or unlocked position, wherein the tab lock 200 has been pulled back away from the plug 206. Here, the tab lock 200 has been pulled back to the extent that the proximal edge 416 of the fourth facet 512 (see FIG. 5) is in contact with the inner corner 618 of the finger 606 (see FIG. 6). As illustrated in FIG. 8B, the proximal edge 416 and the inner corner 618 are adapted such that when they are in contact in the unlocked position, at least a portion of the tongue 202 is not reached by the release lever 204 when the finger 216 is pressed downward. In this way, the release lever 204 substantially retains its default flexibility, such that when the release lever 204 is pressed downward the latch 220 moves sufficiently downward to release the plug 206 from the jack.

In various embodiments, the entirety of the tongue 202 may need not completely avoid contact with the release lever 204 in order to allow the latch 220 fully to disengage the plug 206 from the jack. That is, referring to FIG. 5, at least a portion of the first facet 504 may contact the release lever 204 yet still providing for the release of the latch 220 from the jack. However, in the embodiment illustrated in cross section in FIG. 5, if the release lever 204 comes into contact with the second facet 508, then pressing down on the release lever 204 and/or the finger 216 will fail to cause the latch 220 to release from the jack. In various embodiments in accordance with aspects of this disclosure, a portion of the tongue should have a certain minimum thickness when in its forward or locked position in order substantially to prevent the latch 220 from releasing the plug 206 from the jack by keeping at least a portion of the release lever 204 away from the surface of the plug 206 by at least the minimum thickness. Depending on the dimensional tolerance allowed in a particular implementation, this thickness could be as small as 0.001 inches. However, in accordance with an exemplary embodiment, the thickness is greater than 0.012 inches. That is, if the relevant portion of the tongue 202 has a thickness of less than or equal to 0.012 inches, the latch may not be prevented from releasing the plug 100% of the time. However, even below this thickness the latch may perform acceptably well, for example, by at least making it somewhat more difficult to unlock and release the plug from the jack. However, in general, the thicker this thickness, the more likely the tab lock is to prevent the latch from becoming released inadvertently.

For example, one embodiment as illustrated in cross-section in FIG. 5 has a thickness of 0.029 inches between the second facet 508 and the bottom surface 514. In this embodiment, as long as the tab lock 200 is slid forward to a distance where the second facet 508 comes into contact with the release lever 204 when the release lever 204 is pressed downward, the tab lock 200 may function to defeat the latch 220 and substantially prevent the plug 206 from being released from the latch. However, as the tab lock 200 is pulled back far enough such that the second facet 508 is not in contact with the release lever 204 when the release lever 204 is pressed downward, the latch may be enabled to function to release the plug 206 from the jack. Of course, in the embodiment illustrated in FIG. 5, portions of the first facet 504 are thick enough to cause the latch 220 to still be locked when the release lever 204 contacts those portions of the first facet 504, even though the release lever 204 does not contact the second facet 508. However, as the first facet 504 slopes downward, there may be at least a portion of the first facet 504 that would not defeat the latch 220; that is, even if the release lever 204 comes into contact with a portion of the first facet 504 the latch 220 may still enable the plug 206 to be released from the jack.

As discussed above, the first facet 504 rises from the bottom surface 514 of the tongue 202 at an angle θ of about 13°. However, other angles may be utilized. Here, this angle θ may be less than or equal to the angle at which the release lever 204 rises from the plug 206. The purpose of the portion of the tongue 202 including the first facet 504 is to allow the tab lock 200 to be slid all the way forward until the tip 506 of the tongue 202 comes into contact with the release lever 204. That is, although the first facet 504 may be omitted in certain examples, without this first facet 504, the tongue 202 may damage the release lever 204 if the tab lock 200 were pushed forward into its lock position with a relatively great force. That is, the angle of the first facet 504 allows the distal tip 506 of the tongue 202 to impact the release lever 204 at a location that should not damage the release lever 204.

The tab lock 200 and associated components described provide for a physically small and simple to use yet effective mechanism for locking a plug, for example, an RJ45 plug into its jack such that the likelihood that the plug is inadvertently removed from the jack is reduced or eliminated. In this way, network downtime may be enhanced by reducing or eliminating inadvertent disconnections. The relatively small physical size possible with the disclosed tab lock provides for a locking mechanism that may function in an extremely densely configured server or other computer network equipment with large numbers of jacks closely placed together. Further, the tab locks may be utilized in flush or recessed jacks as well as jacks that protrude outward from a surface of the server. Moreover, the tab lock provides for securing and releasing the plug without a need for a key or other tool.

Further, the clasp 208 may function to provide a readily recognized visual cue that a particular plug has its tab lock in its unlocked position. That is, in a scenario where a server or network device has a number of cables plugged into it, certain ones of the plugs may be desired to be temporarily easily identified. In an aspect of the instant disclosure, the tab lock 200 may be pulled out into its unlocked position. Here, the tab lock that is in its unlocked position is easily identified even from a relatively great distance, as other tab locks may be pushed into their locked position. The identification of the tab lock that is pulled into its unlocked position may be further enhanced when the clasp or other rear portion of the tab lock has a conspicuous color or light, particularly when the color contrasts from that of the server and/or the cable itself. Moreover, utilizing a variety of colors of tab locks provides for color coding of the plugs as determined by a user.

According to various aspects of the disclosure, the materials utilized to construct the plug, the tab lock, and the base/strain relief may be any suitable material, and may be materials different from one another. For example, in an embodiment configured to be utilized with an RJ45 plug, the plug may be any material capable of having its release lever flex to a suitable degree to enable the latching and unlatching in accordance with the relevant specifications for the RJ45 plug. The base and strain relief member may be the same or different material, and the tab lock may be any material having sufficient rigidity to support the pushing and pulling of the tab lock into its locked and unlocked position, and to substantially hinder the bending of the release lever of the plug to such a degree as to release the latch from the jack.

Figure 9:
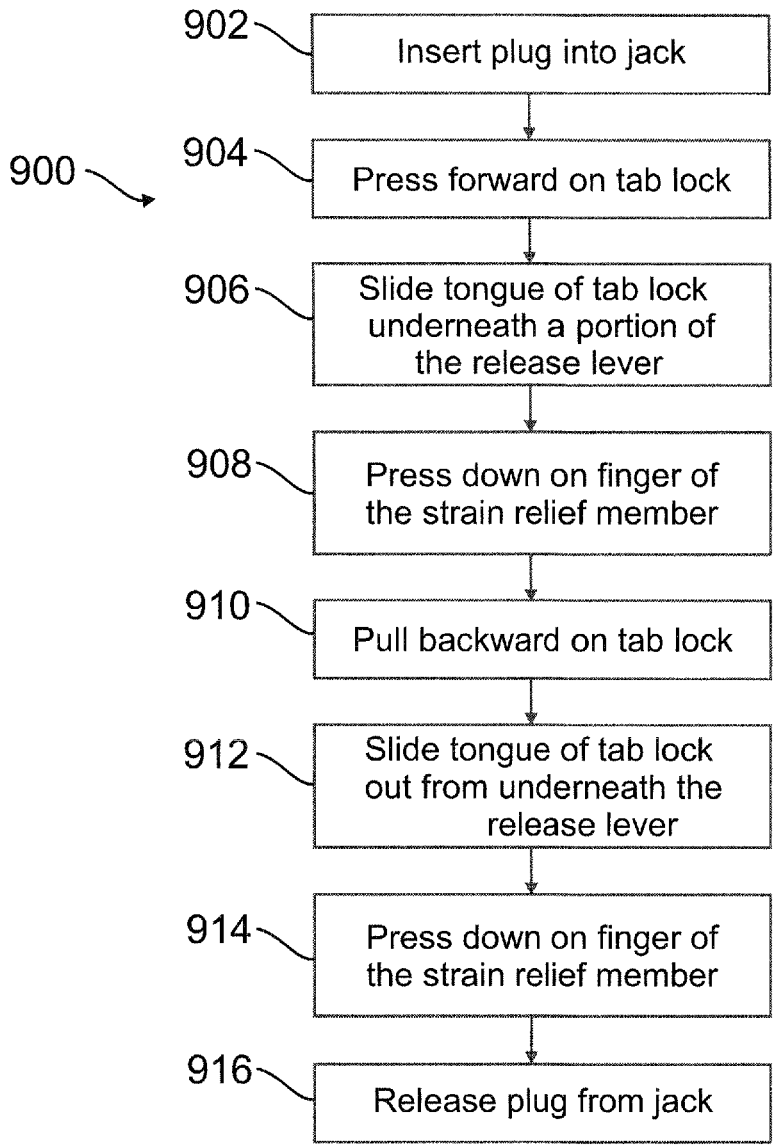
FIG. 9 is a flow chart illustrating a method of securing a plug in a jack utilizing a cable lock apparatus in accordance with an exemplary aspect of the present disclosure.
Figure 10A:
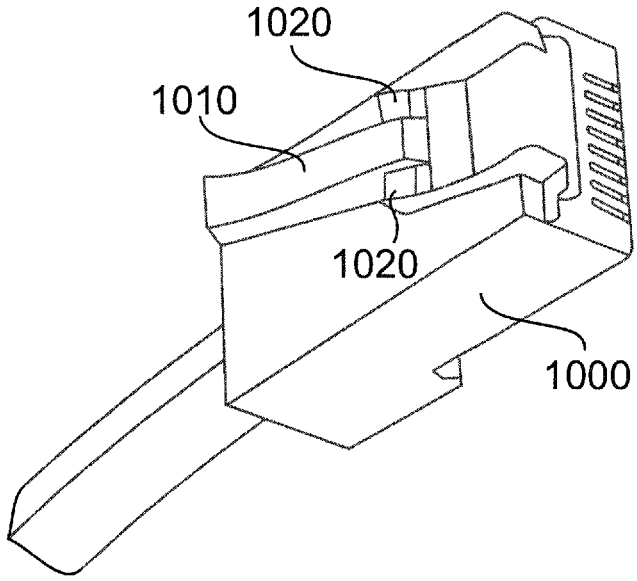
FIG. 10A (Prior Art)
FIGS. 10A-10C illustrate an RJ45 plug, an array of RJ45 jacks, and a server rack as in the prior art.
Figure 10B:
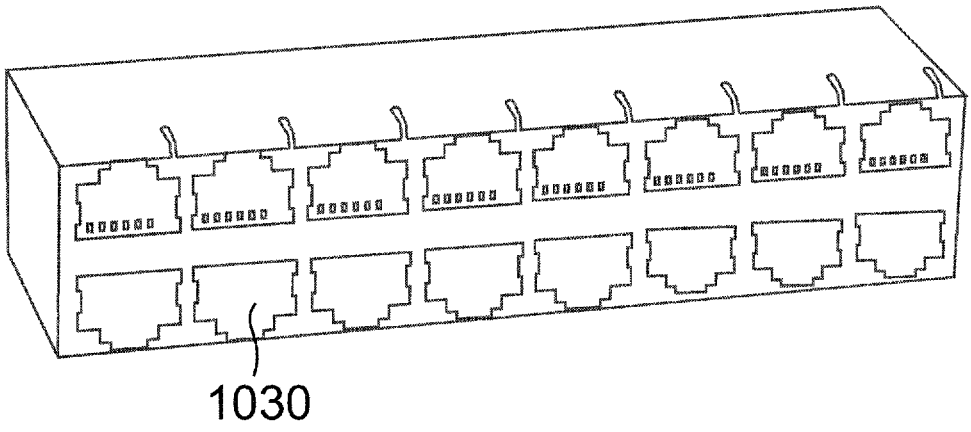
FIG. 10B (Prior Art)
Figure 10C:
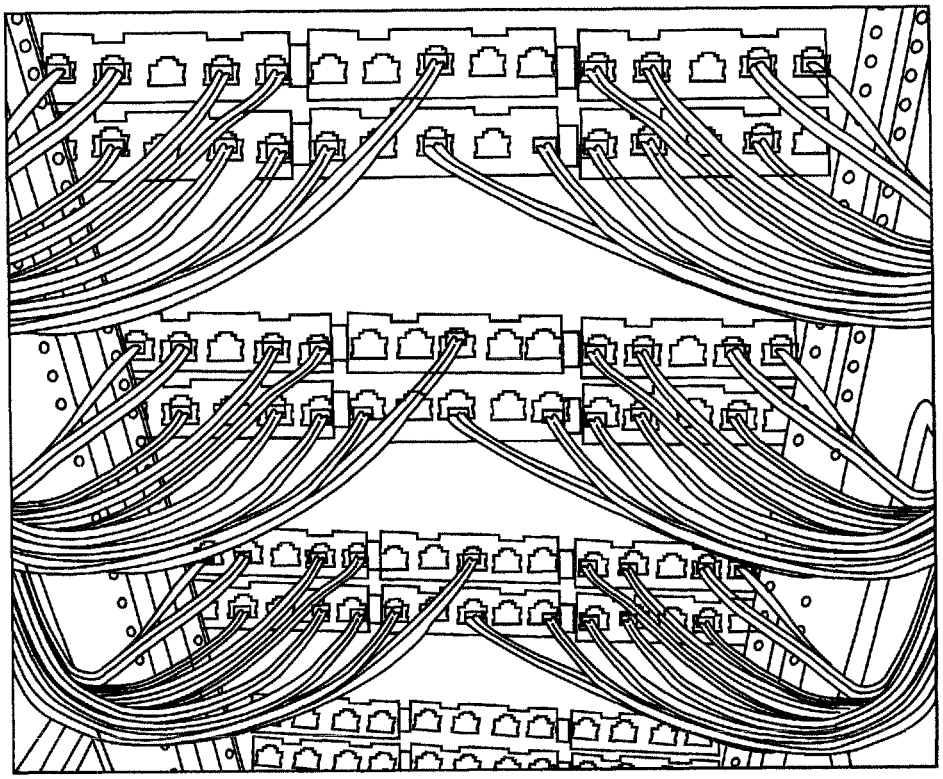
FIG. 10C (Prior Art)

FIG. 9 is a flow chart illustrating an exemplary process 900 of locking and releasing a plug in a jack in accordance with an aspect of the disclosure. In block 902, a plug including a tab lock is inserted into a jack. For example, an RJ45 plug may be inserted into a suitable jack until the latch on its release lever snaps into place, securing the plug in the jack. In block 904, the tab lock is pressed forward. For example, a user may utilize a grip or recessed portion 410 (see FIG. 4) on a tab lock to facilitate pressing it forward. In another example, the tab lock may not include such a grip or recessed portion, and a clasp 412 or any other suitable portion of tab lock itself may be grasped or touched to press the tab lock forward. In block 906, a tongue extending distally from a front portion of the tab lock slides underneath a portion of a release lever on the plug. In this way, the release lever is hindered from releasing the latch when it is pressed. That is, in block 908, the finger of the strain relief member is pressed downward. This, in turn, causes the release lever to be pressed down, however, due to the distally extending tongue, the latch remains latched to the jack and the plug may not be removed from the jack.

In block 910, the tab lock is pulled backward, for example, by utilizing the grip or recessed portion to grasp the tab lock and pull it away from the jack. In block 912, due to the pulling backward on the tab lock, the tongue of the tab lock slides out from underneath the release lever. Therefore, in block 914, when the finger of the strain relief member is pressed downward, the release lever bends down in a substantially unhindered fashion to release the latch from the corresponding latch in the jack. Thus, in block 916, the plug is released from the jack by pulling on the plug.

In the foregoing specification, the invention has been described with reference to specific exemplary embodiments. Various modifications and changes may be made, however, without departing from the scope of the present invention as set forth in the claims. The specification and figures are illustrative, rather than restrictive, and modifications are intended to be included within the scope of the present invention. Accordingly, the scope of the invention should be determined by the claims and their legal equivalents rather than by merely the examples described.

For example, the steps recited in any method or process claims may be executed in any order and are not limited to the specific order presented in the claims. Additionally, the components and/or elements recited in any apparatus claims may be assembled or otherwise operationally configured in a variety of permutations and are accordingly not limited to the specific configuration recited in the claims.

Benefits, other advantages and solutions to problems have been described above with regard to particular embodiments; however, any benefit, advantage, solution to a problem, or any element that may cause any particular benefit, advantage, or solution to occur or to become more pronounced are not to be construed as critical, required, or essential features or components of any or all the claims.

As used herein, the terms "comprise," "comprises," "comprising," "having," "including," "includes" or any variation thereof, are intended to reference a non-exclusive inclusion, such that a process, method, article, composition or apparatus that comprises a list of elements does not include only those elements recited, but may also include other elements not expressly listed or inherent to such process, method, article, composition, or apparatus. Other combinations and/or modifications of the above-described structures, arrangements, applications, proportions, elements, materials, or components used in the practice of the present invention, in addition to those not specifically recited, may be varied or otherwise particularly adapted to specific environments, manufacturing specifications, design parameters, or other operating requirements without departing from the general principles of the same.

What is claimed is:

1. A method of securing a plug in a jack, comprising:

inserting the plug into the jack to engage a latch on the plug into the jack;

pressing forward on a tab lock to slide at least a portion of a distally extending tongue of the tab lock underneath a portion of a release lever coupled to the latch to hinder a releasing of the latch coupled to the release lever from a corresponding latch in the jack without use of a provided key or remove tool, the tab lock further comprising:

a body having two extending arms extending distally from the body to couple the distally extending tongue to the body such that a slot is formed in the tab lock between the body and the distally extending tongue;

a gripping portion on the body to facilitate gripping the tab lock; and relieving strain on a cable coupled to the plug using a base comprising a strain relief and a fastener to fasten the base to the plug.

2. The method of claim 1, further comprising:

pulling backward on the tab lock to remove the portion of the distally extending tongue of the tab lock from underneath the portion of the release lever;

pressing down on the release lever to release the latch from the jack; and removing the plug from the jack.

3. The method of claim 1, further comprising:

pressing down on the release lever to bend the release lever until at least a portion of the release lever comes into contact with at least a portion of the distally extending tongue; and pulling on the plug to cause the latch to further engage with the jack without releasing the plug from the jack.

4. The method of claim 1, wherein the at least a portion of the distally extending tongue of the tab lock has a thickness of greater than 0.012 inches.

5. The method of claim 4, wherein the at least a portion of the distally extending tongue of the tab lock has a thickness of about 0.029 inches.

6. An apparatus for securing a plug in a jack, comprising:

a tab lock comprising a distally extending tongue, wherein at least a portion of the distally extending tongue is configured to slide underneath a release lever of the plug to hinder a releasing of a latch coupled to the release lever from a corresponding latch in the jack without use of a provided key or remove tool, the tab lock further comprising:

a body having two extending arms extending distally from the body to couple the distally extending tongue to the body such that a slot is formed in the tab lock between the body and the distally extending tongue;

a gripping portion on the body to facilitate gripping the tab lock;

a base comprising a strain relief member for relieving strain on a cable coupled to the plug; and a fastener for fastening the base to the plug.

7. The apparatus of claim 6, wherein the gripping portion comprises a recessed portion in the body of the tab lock.

8. The apparatus of claim 6, wherein the base further comprises:

a finger extending through the slot in the tab lock to provide a stop for hindering the tab lock from being fully removed from the plug when the tab lock is slid backward away from the plug.

9. The apparatus of claim 8, wherein the finger extends to cover at least a portion of the release lever of the plug such that pressing downward on the finger causes the release lever to be pressed downward.

10. The apparatus of claim 8, wherein the distally extending tongue of the tab lock further comprises:

a bottom surface;

a distal tip;

a first facet rising from the distal tip at a first angle; and a second facet, wherein a thickness between the bottom surface and the second facet is greater than 0.001 inches.

11. The apparatus of claim 10, wherein the first angle is about thirteen degrees.

12. The apparatus of claim 10, wherein the thickness between the bottom surface and the second facet is greater than 0.012 inches.

13. The apparatus of claim 12, wherein the thickness between the bottom surface and the second facet is about 0.029 inches.

14. The apparatus of claim 12, wherein the distally extending tongue further comprises:

a third facet rising from the second facet at a second angle; and a fourth facet tapering downward from the third facet, terminating at the bottom surface.

15. The apparatus of claim 14, wherein the second angle is about fifteen degrees.

16. The apparatus of claim 14, wherein the terminating of the third facet at the bottom surface is configured to physically contact the finger of the base when the tab lock is pulled into an unlocked position.

* * * * *